US009574358B2

(12) United States Patent
Deason

(10) Patent No.: US 9,574,358 B2
(45) Date of Patent: Feb. 21, 2017

(54) SYSTEM TO FORM POOL DECK AND COPING ON FIBERGLASS AND VINYL-LINED POOLS

(71) Applicant: Ted E Deason, Tucson, AZ (US)

(72) Inventor: Ted E Deason, Tucson, AZ (US)

( * ) Notice: Subject to any disclaimer, the term of this patent is extended or adjusted under 35 U.S.C. 154(b) by 0 days.

(21) Appl. No.: 14/998,760

(22) Filed: Feb. 11, 2016

(65) Prior Publication Data

US 2016/0237703 A1 Aug. 18, 2016

Related U.S. Application Data

(60) Provisional application No. 62/176,389, filed on Feb. 13, 2015.

(51) Int. Cl.

| | |
|---|---|
| ***E04G 13/06*** | (2006.01) |
| ***E04G 13/00*** | (2006.01) |
| ***E04H 4/14*** | (2006.01) |
| ***E04G 17/00*** | (2006.01) |

(52) U.S. Cl.

CPC ..... *E04G 13/00* (2013.01); *E04G 13/06* (2013.01); *E04G 17/00* (2013.01); *E04H 4/141* (2013.01); *E04H 2004/147* (2013.01)

(58) Field of Classification Search

CPC ..... E04G 13/00; E04G 13/06; E04G 13/062; E04G 13/064; E04H 4/141

USPC ..... 52/169.7

See application file for complete search history.

(56) References Cited

U.S. PATENT DOCUMENTS

| | | | | |
|---|---|---|---|---|
| 3,371,455 | A * | 3/1968 | Fox | E04H 4/0018 4/506 |
| 3,776,501 | A * | 12/1973 | Loftin | E04H 4/141 249/2 |
| 4,387,877 | A * | 6/1983 | Deason | E04G 13/00 249/10 |
| 4,395,014 | A * | 7/1983 | Deason | E04H 4/141 249/10 |
| 4,706,308 | A * | 11/1987 | Palmere | E04H 4/142 4/496 |
| 4,735,395 | A * | 4/1988 | Dahowski | E02D 29/16 249/10 |
| 6,260,313 | B1 * | 7/2001 | Stegmeier | E04H 4/142 4/488 |
| 6,529,664 | B1 * | 3/2003 | Deason | E04H 4/141 156/245 |
| 2005/0001139 | A1 * | 1/2005 | Musser | E04G 11/365 249/23 |
| 2016/0115701 | A1 * | 4/2016 | Baldoni | E04H 4/141 52/300 |

* cited by examiner

*Primary Examiner* — Michael Safavi
(74) *Attorney, Agent, or Firm* — Tod R. Nissle, P.C.

(57) ABSTRACT

A form system for a fiberglass or vinyl-lined swimming pool utilizes an elongate pliable form, a bracket, a spear, and a button mounted on the spear to secure the bracket in position against the form. The bracket and form are shaped and dimensioned such that when the bracket placed against the form, it conforms to the form, it is automatically properly positioned to receive the spear, to support the form in the desired position with respect to the bracket, and to generate a compression vector, $V_C$, which frictionally secures the bracket to the wall of the swimming pool.

2 Claims, 12 Drawing Sheets

SYSTEM TO FORM POOL DECK AND COPING ON FIBERGLASS AND VINYL-LINED POOLS

This invention claims priority based on the provisional patent application Ser. No. 62/176,889, filed Feb. 13, 2015.

This invention relates to swimming pools and other water reservoirs.

More particularly, the invention relates to method and apparatus for forming a deck and coping circumferentially around the periphery of the swimming pool.

Those of skill in the art have, for many years, endeavored to develop improved methods and apparatus for constructing decks and coping around swimming pools and other water reservoirs.

Therefore, it would be highly desirable to produce an improved method and apparatus for constructing a deck and coping along the periphery of a swimming pool or other water reservoir.

Accordingly, an object of the invention is to provide an improved apparatus and method to construct the deck of a swimming pool.

This, and other and more specific objects of the invention, will be apparent to those of skill in the art when taken in conjunction with the drawings, in which.

Figure 12:
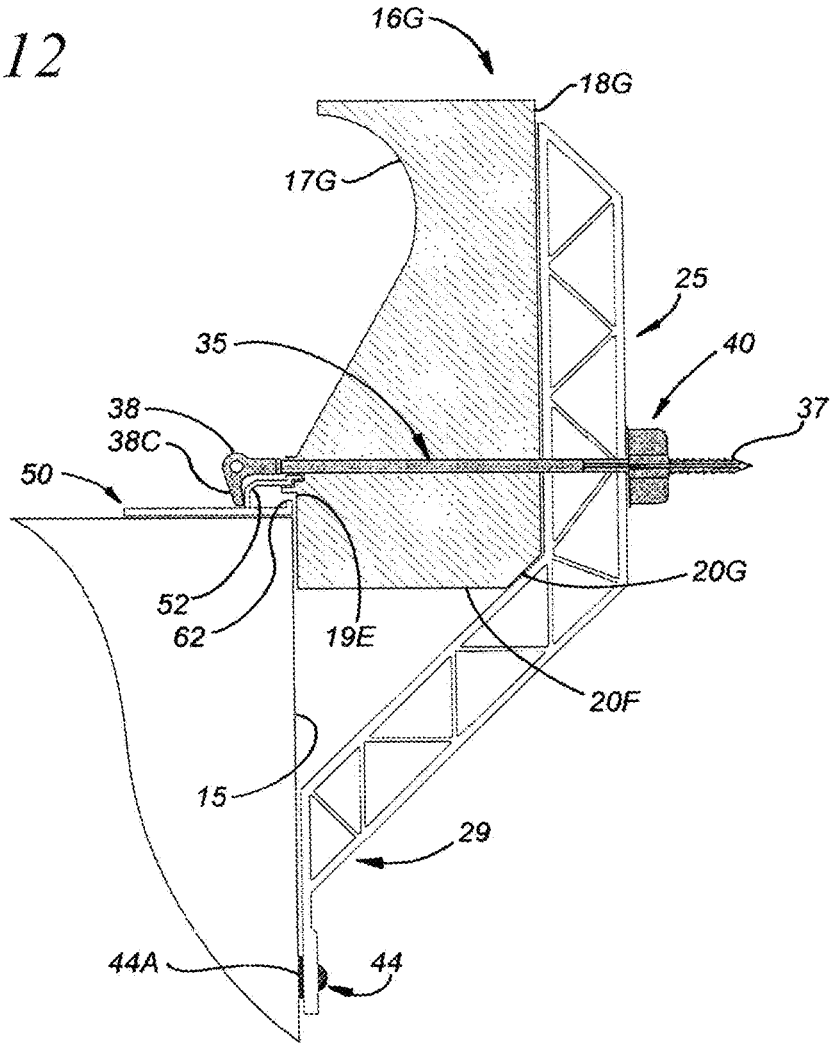
Figure 13:
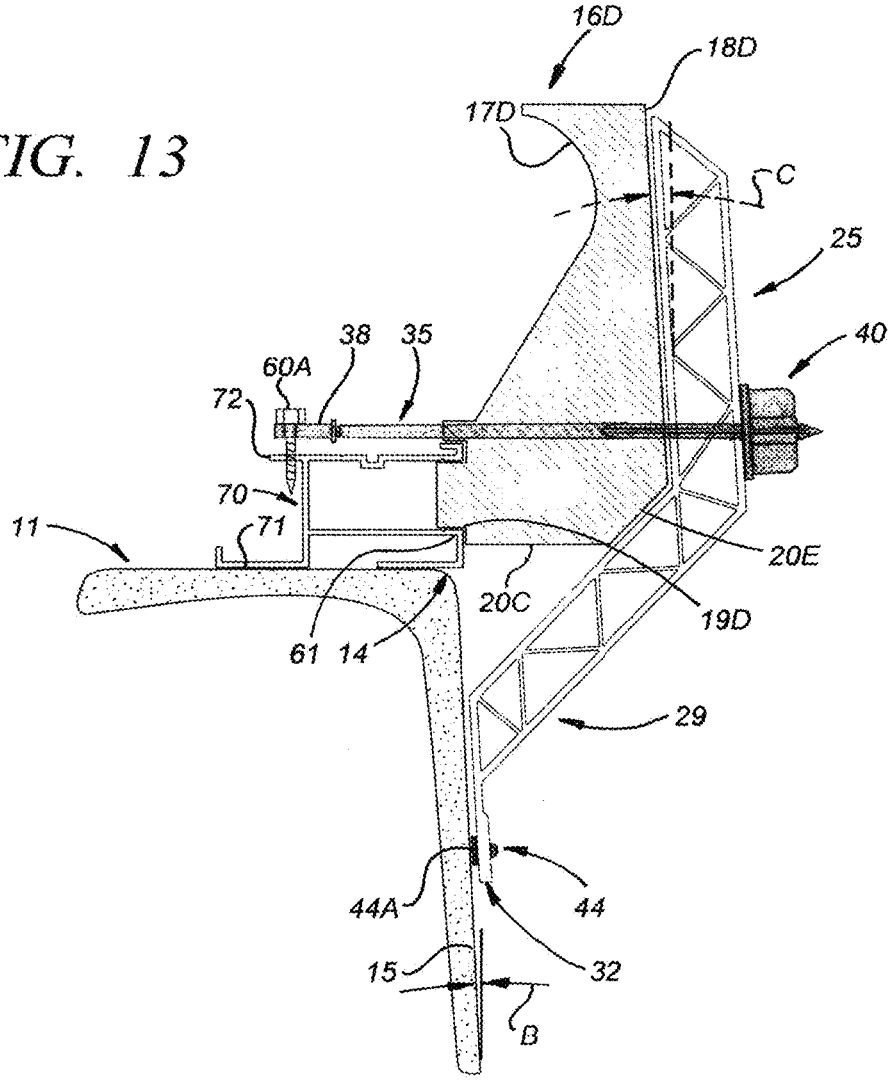

FIG. 12 is a side view further illustrating a form system constructed in accordance with the invention for a vinyl liner swimming pool; and, FIG. 13 is a side view illustrating a form system which is constructed in accordance with the invention for a fiberglass swimming pool and which includes an encapsulation track to facilitate the application of a pool cover extending over the top of the swimming pool.

Briefly, I provide an improved form system for a swimming pool. The swimming pool has a substantially vertically extending pool wall circumscribing an interior reservoir space, and includes a top including an upper edge, and, having an inner surface extending downwardly from said upper edge and comprised of a material selected from a group consisting of fiberglass and vinyl. The improved form system comprises an elongate form of a semirigid material. The form has a longitudinal length; is pliable along the longitudinal length; is substantially rigid transverse of the longitudinal length; has a contoured face to form a deck coping, the contoured face extending at least in part over the interior reservoir space; has a substantially vertical back spaced apart from and opposed to the face; has a longitudinal lip below the contoured face and conforming to and contacting the upper edge; has a bottom surface; has a horizontally oriented reference line extending across the back; and, extends outwardly from the pool wall into the interior reservoir space. The improved form system also comprises a bracket. The bracket includes a vertically oriented head. The head has an inner surface contacting the back of the form, the inner surface being shaped and dimensioned to conform to and support the back of the form. The head also has an aperture extending through said head. The bracket also includes a leg. The leg has an upper end connected to the head; extends beneath the form downwardly from the head at an angle A to the pool wall; has a lower end; and, contacts and supports the bottom surface of the form. The bracket also includes a foot. The foot is connected to and extends outwardly from the lower end of the leg and frictionally non-fixedly contacts the inner surface of the pool wall. The improved form system also includes an elongate spear. The spear has a head secured in position above the top of the pool wall; and, includes a leg extending through the elongate form. The leg has a serrated end extending through and outwardly away from the vertical back and the reference line and through the aperture in the head of the bracket. The improved form system also includes a locking button fixedly slidably mounted on the serrated end and against the head to compress the form against the pool wall. The angle between the leg and the pool wall is in the range of twenty degrees to sixty degrees such that the foot generates a compression force vector, $V_C$, to press the foot against the pool wall, and increase frictional engagement between said foot and the pool wall sufficiently to maintain the foot in position on the pool wall and support the form when concrete contacts the contoured face extending over the interior reservoir space. The form and bracket are shaped and dimensioned such that when the serrated end of the spear passes through the aperture in the bracket, the leg of the bracket contacts the bottom of the form and supports the form.

Figure 1:
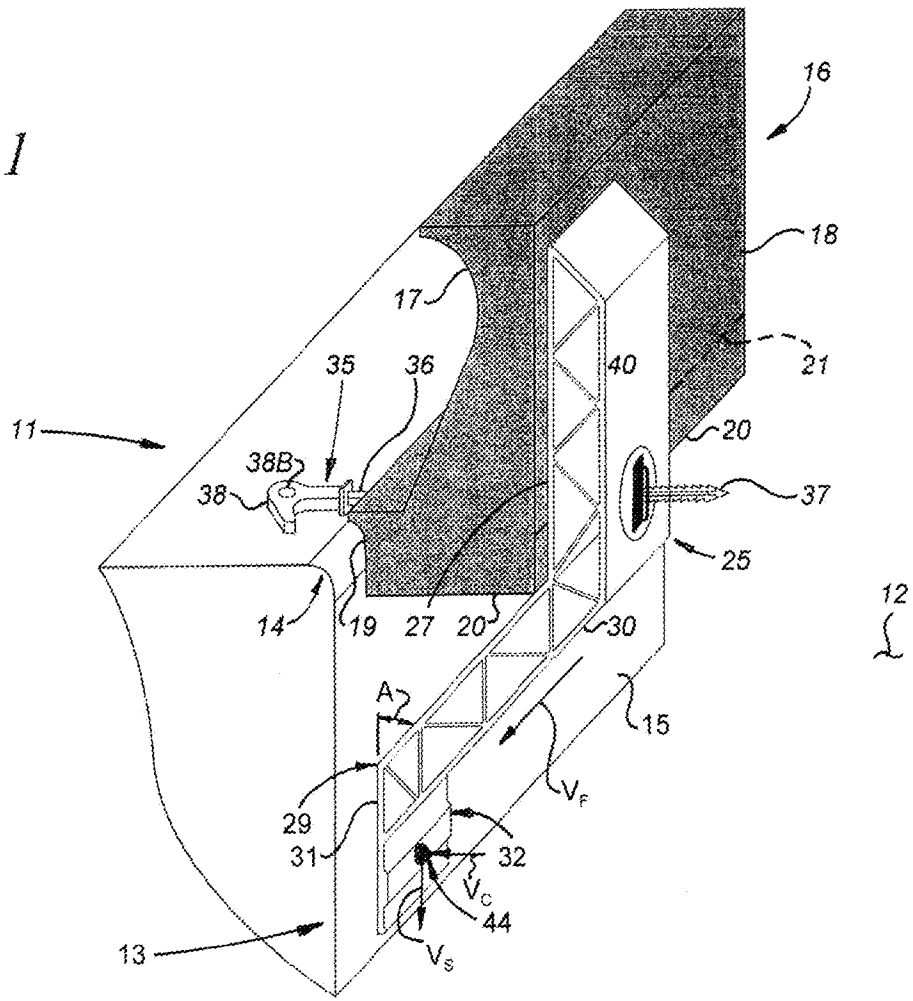
FIG. 1 is a perspective view illustrating a form system constructed in accordance with the invention for a fiberglass swimming pool.

Turning now to the drawings which depict the presently preferred embodiments of the invention for the purpose of illustration and not by way of limitation of the invention, and in which like reference characters identify corresponding elements throughout the several views, FIG. 1 illustrates a form system for a fiberglass pool 10. The swimming pool 10 has a substantially vertically extending pool wall 13 circumscribing an interior reservoir space 12. The wall includes a top 11 including an upper edge 14, and, an inner surface 15 extending downwardly from the upper edge 14 and comprised of fiberglass.

The form system comprises an elongate form 16 of a semirigid material that has a longitudinal length; that is pliable along the longitudinal length to facilitate bending form 16 around curved edges of a swimming pool; that is substantially rigid transverse of the longitudinal length; that has a contoured face 17 to form a deck coping, the contoured face 17 extending at least in part over the interior reservoir space 12; that has a substantially vertical back 18 spaced apart from and opposed to the face 17; that has a longitudinal lip 19 that is below the contoured face 17 and that conforms to and contacts the upper edge 14 of the top 11 of the pool wall 13; that has a bottom surface 20; and, that has a horizontally oriented reference line 21 extending across the back 18, and, that extends outwardly from the pool wall over the interior reservoir space 12. Reference line 21 can be Inscribed on back 18, can be formed as an elongate linear detent in back 18, can be approximated visually as an imaginary line parallel and spaced apart from the lower edge of form 16 at which back 18 and bottom 20 co-terminate, etc.

The form system also includes a bracket 25. Bracket 25 includes a vertically oriented head 26 with an inner surface 27 contacting the back 18 of form 16, the inner surface shaped and dimensioned to conform to and support the back 18 of form 16; and, includes an aperture 28 extending through the head 26.

Bracket 25 also includes a leg 29. Leg 29 has an upper end 30 connected to the head 26; extends beneath the form 16 downwardly from head 26 at an angle A to the pool wall 13; has a lower end 31; and, contacts and supports the bottom surface 20 of form 16. Leg 29 also has a foot 32 connected to and extending outwardly from the lower end 31 of leg 29. Foot 32 frictionally non-fixedly contacts the inner surface 15 of pool wall 13. Foot 32 includes a pad 44 with a surface 44A which contacts and frictionally removably releasably engages inner surface 15. Surface 44A preferably is comprised of a relatively soft pliable polymer or rubber which will conform to and frictionally engage surface 15. While the material used to construct surface 44A and pad 44 can vary as desired, pad 44 definitely preferably is riot constructed of a relatively hard material which readily slides over surface 14.

Figure 1A:
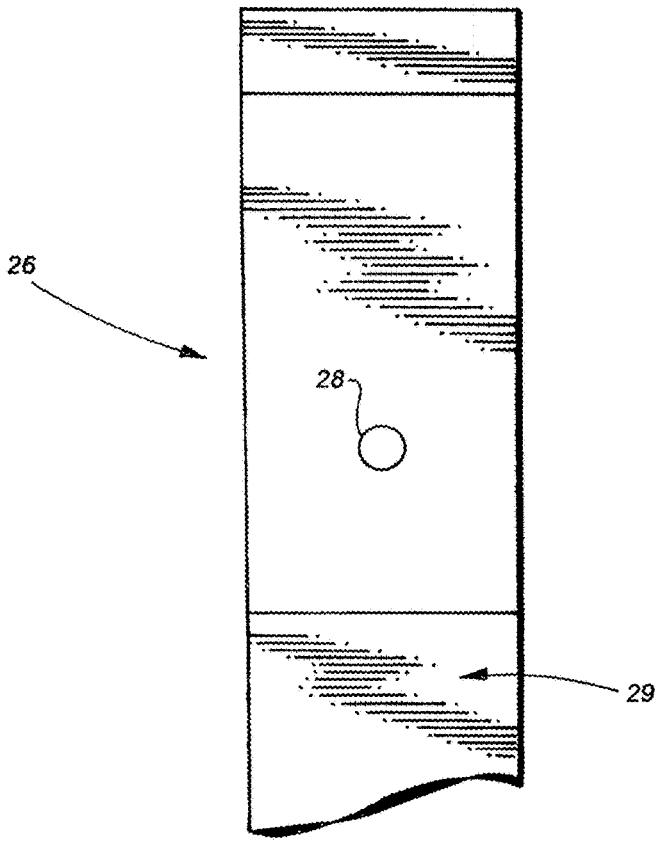
FIG. 1A is a front view of a bracket used in the invention illustrating construction details thereof.

The form system also includes an elongate spear 35. Spear 35 has a head 38 secured in position above the top 11 of the pool wall 13. Aperture 38B is formed through head 38 to facilitate passing a nail, screw, or other fastener through head 38 via aperture 38B. Spear 35 includes a leg 36 extending through elongate form 16. Leg 36 has a serrated end 37 extending through and outwardly away from vertical back 18 and reference line 21 and through aperture 28 (FIG. 1A) in head 26 of bracket 25.

The form system also includes a locking button 40 fixedly slidably mounted on serrated end 37 and against head 26 to compress form 16 against the pool wall 13. Button 40 slides onto and locks into position on end 37 in a fashion similar to the way one end of a cable tie slides and locks in position on the toothed, serrated other end of the cable tie. Once button 40 is in a locking position on end 37, it is not readily removed.

After concrete is poured to contact and fill face 17 and form a deck, and, has sufficiently hardened, form 16 is removed by rotating button 40 clockwise or counterclockwise to rotate end 37 simultaneously and cause spear 35 to break and severe at a point of weakening. This point of weakening is not visible in FIG. 1, but is comparable to the point of weakening 54 illustrated in FIG. 8 for spear 35A. Spear 35A is generally identical to spear 35, except that the shape of head 38A is different from the shape of head 38 on spear 35.

The angle A between leg 29 and the pool wall 13 is in the range of twenty degrees to sixty degrees, preferably thirty degrees to fifty degrees, such that foot 32 generates a compression force vector, $V_C$, to press foot 32 against the pool wall 13, and increase frictional engagement between foot 32 and the pool wall 13 sufficiently to maintain foot 32 in position on the pool wall 13 and support form 16 when concrete contacts contoured face 17 positioned over interior reservoir space 12.

Figure 11:
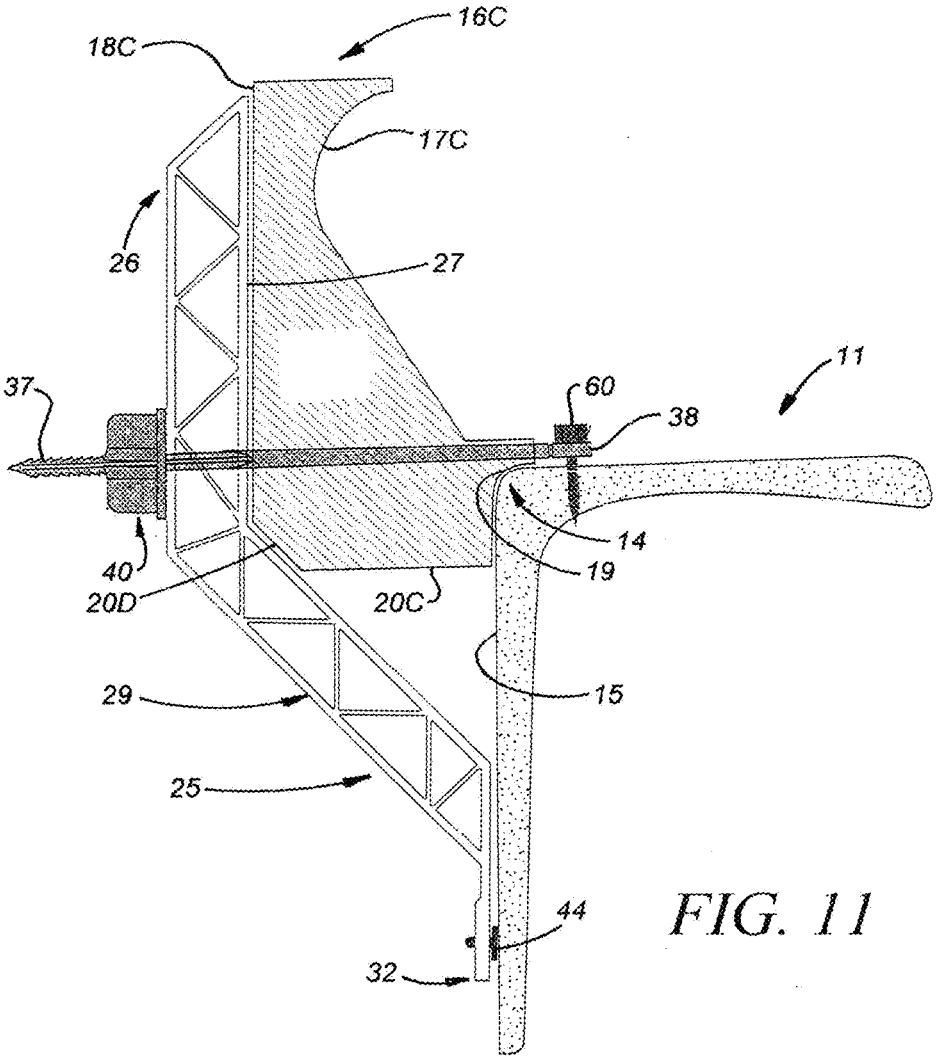
FIG. 11 is a side view further illustrating a form system constructed in accordance with the invention for a fiberglass swimming pool.

Form 16 and bracket 25 are shaped and dimensioned such that when serrated end 37 of spear 35 passes through aperture 28 in bracket 25, leg 29 of bracket 25 contacts bottom surface 20 of form 16 and supports form 16. In FIG. 1, leg 29 contacts bottom surface 20 along the edge at which surface 20 and back 18 co-terminate. In FIG. 11, leg 29 contacts portion 20D of the bottom surface along the edge at which portion 20D and back 18C co-terminate, and also contacts portion 20D over a section of portion 20D which extends from portion 20C to the edge at which portion 20D and back 18C co-terminate.

In FIG. 1, a screw which passes through aperture 38B and turns into the top 11 of pool 10 to secure head 38 in place is not, for the sake of clarity, shown.

After concrete is poured to fill space above top 11 and to extend into form 16 and contact face 17, then, in FIG. 1, the weight of form 16, along with the weight of end 37 (which is negligible) and with the weight of bracket 25 and with the weight of concrete extending into face 17, generate a force vector, $V_F$, having a compression force vector $V_C$ component and a shear force vector, $V_S$, component. Compression force vector, $V_C$, increases the frictional engagement of foot 32 with the surface 15 of wall 13 so that foot 32 continues to engage frictionally fixedly surface 15 and does not slide down surface 15.

The order of installation of the system components in FIG. 1 can vary somewhat, but typically form 16 is installed along edge 14, spear 35 is pushed from top 11 outwardly through form 16 and is targeted to pass through line 21 to the position illustrated in FIG. 1, aperture 28 of bracket 25 is slid over end 37 to the position illustrated in FIG. 1, button 40 is slidably installed over end 37 to a position against head 26, head 38 is grasped and pulled away from edge 14, and, a screw is turned through aperture 38B into top 11 to secure spear 35 in place.

Figure 2:
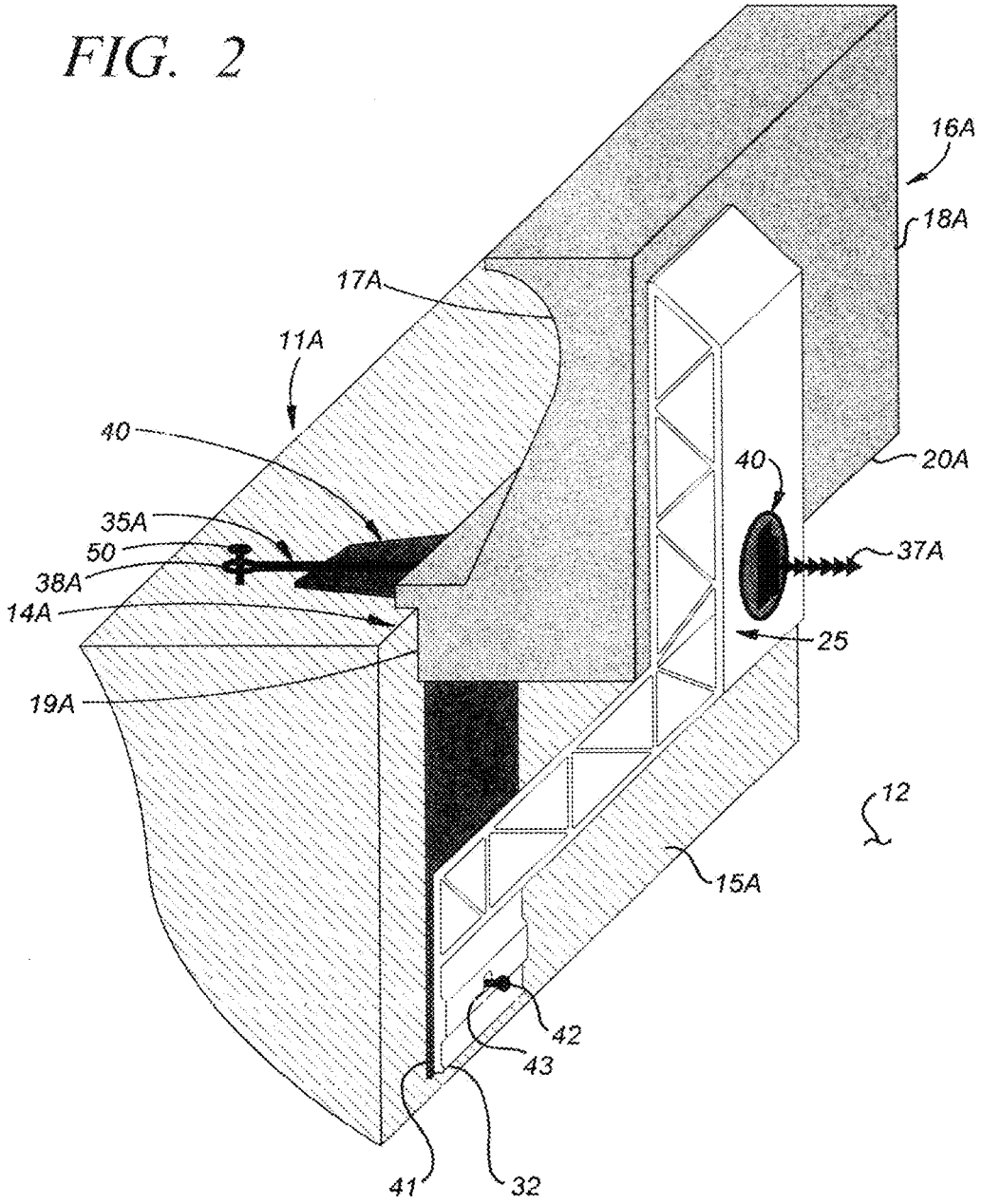
FIG. 2 is a perspective view illustrating another form system constructed in accordance with the invention for a fiberglass swimming pool.

An alternate embodiment of the invention for a fiberglass pool is illustrated in FIG. 2. Form 16A in FIG. 2 is substantially identical to form 16. Form 16A includes, as does form 16, a contoured face 17A, vertically oriented back 18A, and a bottom. The lip 19A, however, of form 16A is not rounded in the fashion of lip 19, but is orthogonal to conform to edge 14A. In FIG. 1, pad 44 is mounted in aperture 43 of foot 32. In FIG. 2, pad 44 is not included. Instead, an L shaped hanger 40 is utilized, and the lower end of hanger 40 includes a support peg 42 which is fixedly secured to hanger 40 and extends outwardly through aperture 43.

Figure 4:
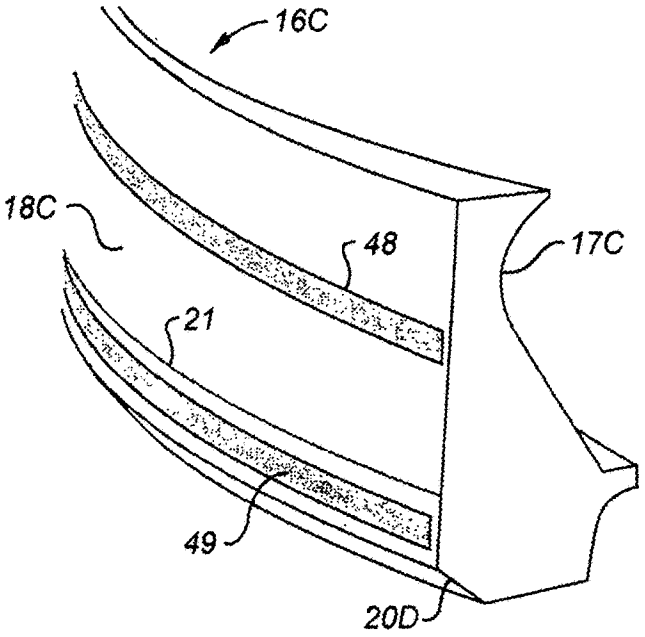
FIG. 4 is a perspective view illustrating the application of tape on the rear vertically oriented side of an elongate pliable form in order to strengthen the form and facilitate bending the form in a fiberglass swimming pool.
Figure 3:
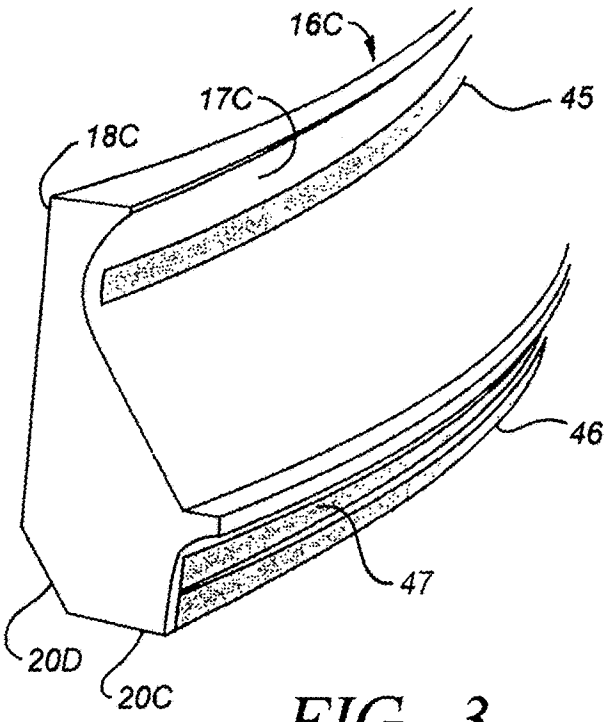
FIG. 3 is a perspective view Illustrating the application of tape on the front contoured side an elongate pliable form in order to strengthen the form and facilitate bending the form for application in a fiberglass swimming pool.

FIGS. 3 and 4 illustrate the application of tape strips 45, 46, 67, 48, 49 to inside and back of a form 16C to strengthen form 16C and facilitate bending form 16C to conform to tape strips is well known in the art.

Figure 5:
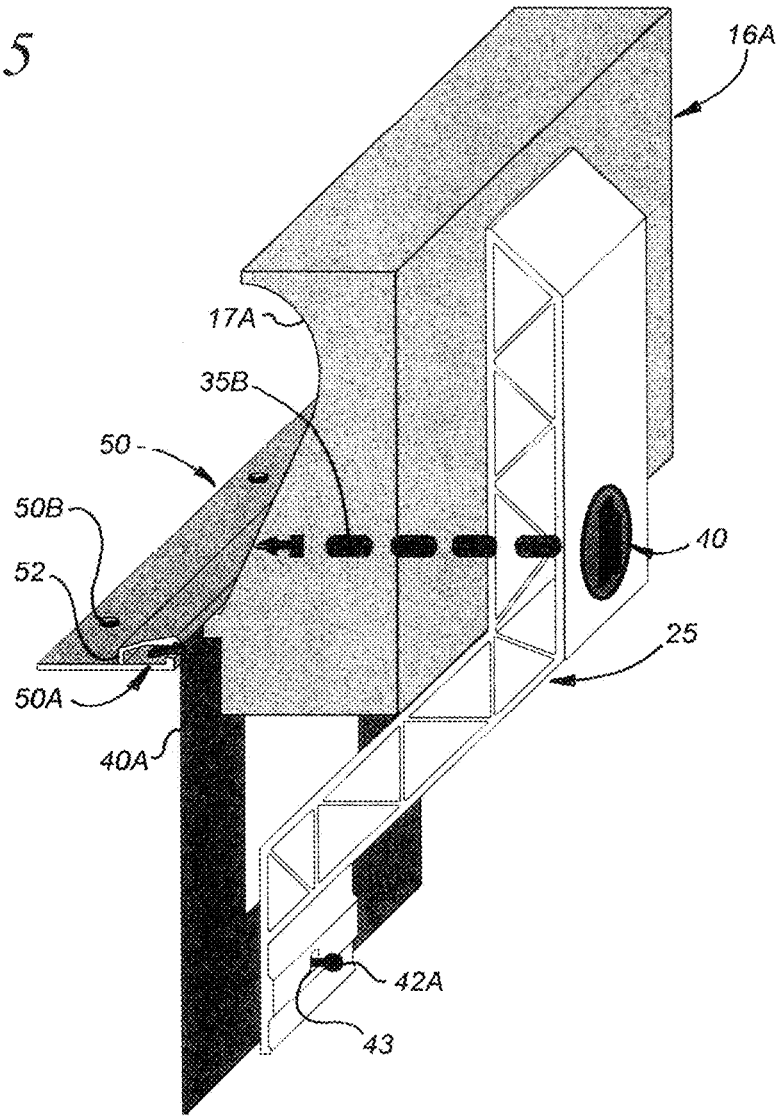
FIG. 5 is a perspective view illustrating a form system constructed in accordance with the invention for a vinyl liner swimming pool.

FIG. 5 illustrates the form system of the invention used in conjunction with a vinyl liner swimming pool. A strip 50 is secured with fasteners 50B along the top of the pool wall. Strip 50 includes a longitudinally extending mouth 50A which receives the edge of a vinyl liner. The vinyl liner can be mounted in the pool before or after concrete is poured to contact face 17A and form a dock around the pool. The vinyl liner is not, for the sake of clarity, shown in FIG. 5. The form system of FIG. 5 does, however, in a manner similar to the system illustrated in FIG. 2, include an L-shaped hanger 40A. Hanger 40A includes a support peg 42A which is fixedly secured to the lower portion of hanger 40A and extends through aperture 43 in bracket 25.

The material used to construct bracket 25 can vary as desired. Bracket 25 is substantially rigid and presently is formed by injection molding a polymer composition. The composition of a form 16, 16A, 16C, 16D, 16G can vary as desired but presently preferably consists of a foam material like, for example, expanded polystyrene.

Figure 6:
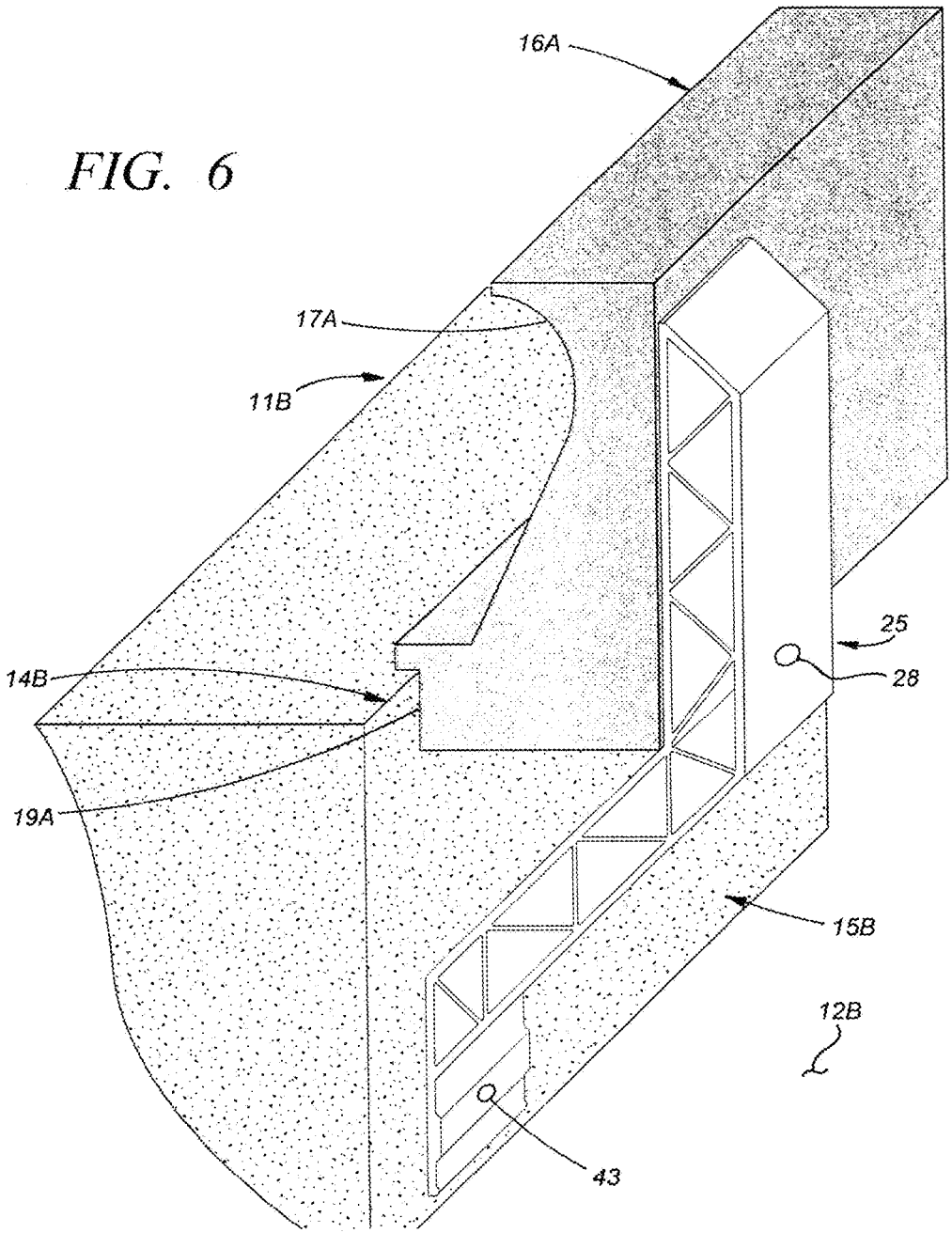
FIG. 6 is a perspective view illustrating portions of a form system constructed in accordance with the invention for a gunite swimming pool.
Figure 7:
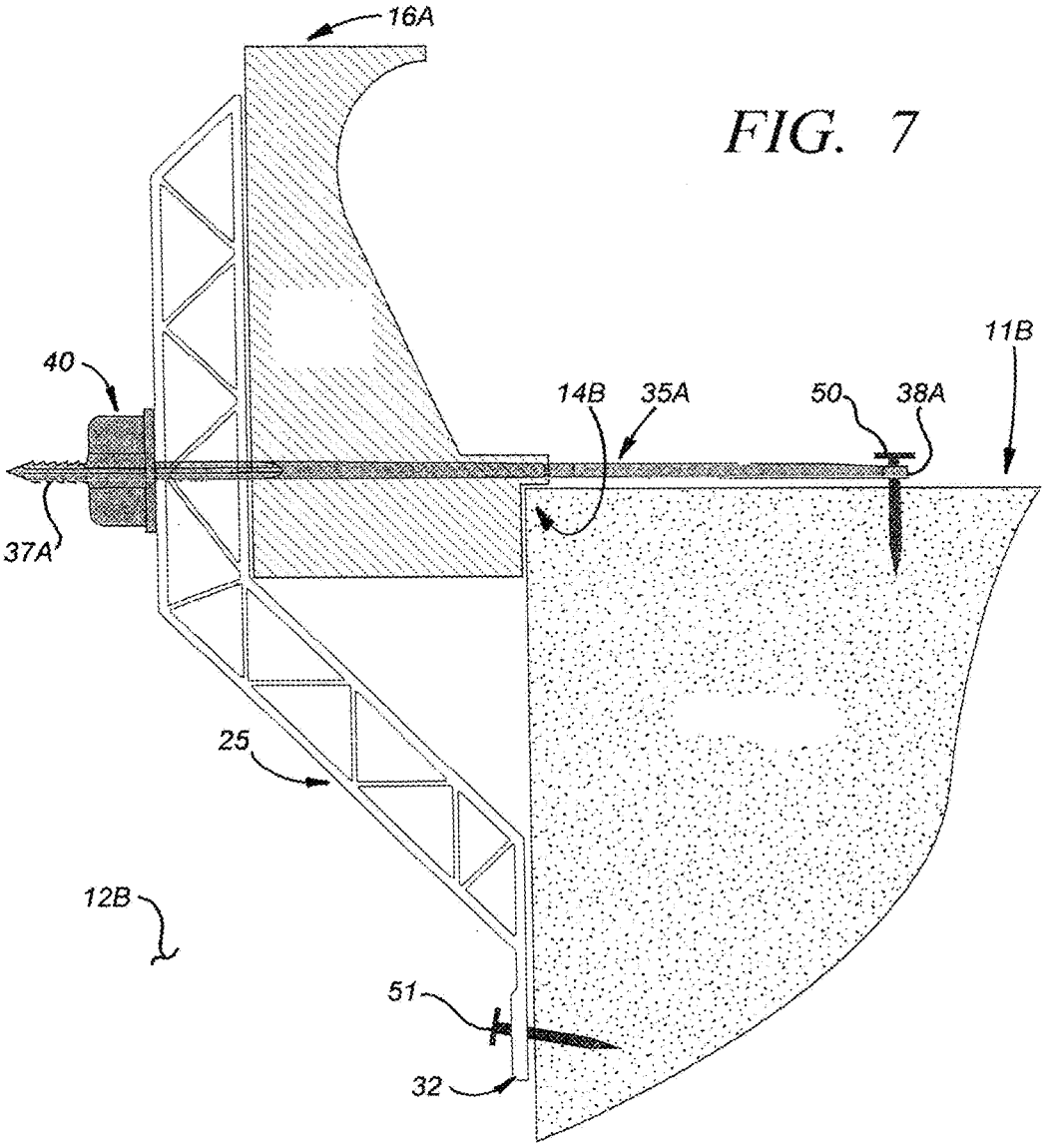
FIG. 7 is a side view illustrating a form system constructed in accordance with the invention for a gunite swimming pool.

FIG. 6 illustrates the placement of a form 16A and bracket 25 on a gunite pool having a top 11B with an upper edge 14B, inner surface 15B, and interior reservoir space 12B. FIG. 7 is a side view of the system illustrated in FIG. 6 with the remaining components of the system in place; namely, spear 35A, button 40, and fasteners, or concrete nails, 50 and 51. The order of installation of the components of the system illustrated in FIG. 7 can vary somewhat, but normally form 16A is positioned along edge 14B in the manner shown, end 37A is pushed outwardly through form 16A to the position shown, aperture 28 of bracket 25 is slipped over end 37A to place bracket 25 in the position shown, button 40 is slipped over end 37A to the position shown, head 38A is pulled in a direction away from interior space 12B to press form 16A against edge 14B, nail 50 is driven through an opening in head 38A to the position shown in FIG. 7, and nail 51 is driven through aperture 43 in foot 32 to the position shown in FIG. 7. Before nail 51 is driven through aperture 43, the bottom of foot 32 can, if desired, be aligned with a chalk line or other horizontal line formed on surface 15; or, foot 32 can be raised or lowered or otherwise positioned in any other desired manner.

Figure 8:
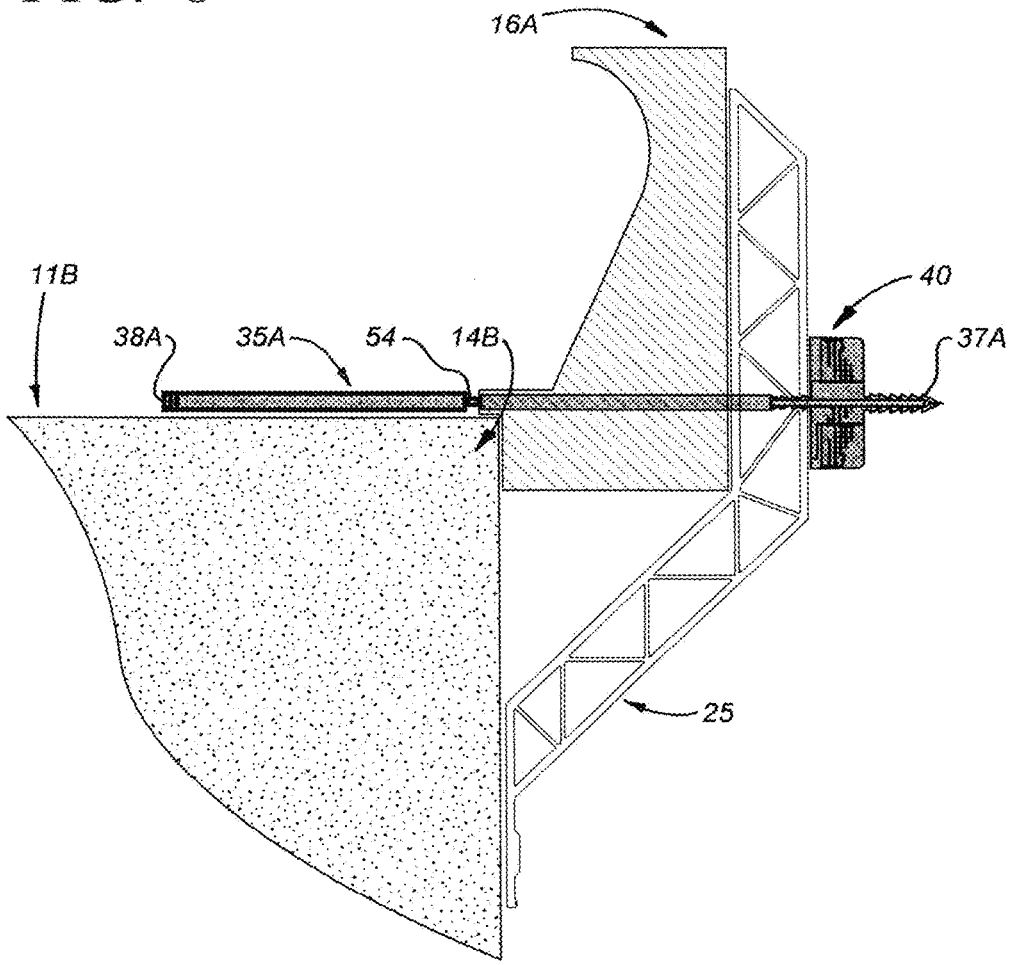
FIG. 8 is a side view further illustrating a form system constructed in accordance with the invention for a gunite swimming pool.

FIG. 8 is a side view of some of the components of the system of FIG. 7. FIG. 8 more clearly illustrates area of weakening 54 which is severed by rotating head 40 and end 37A.

Figure 10:
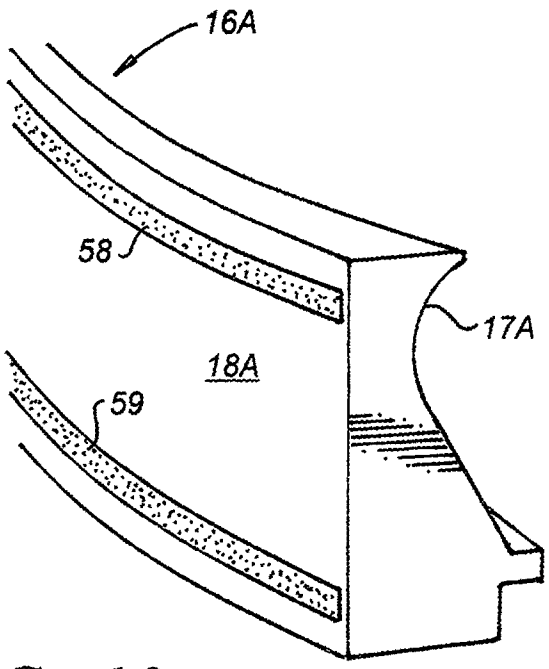
FIG. 10 is a perspective view illustrating the application of tape on the rear vertically oriented side of an elongate pliable form in order to strengthen the form and facilitate bending the form in a gunite swimming pool.
Figure 9:
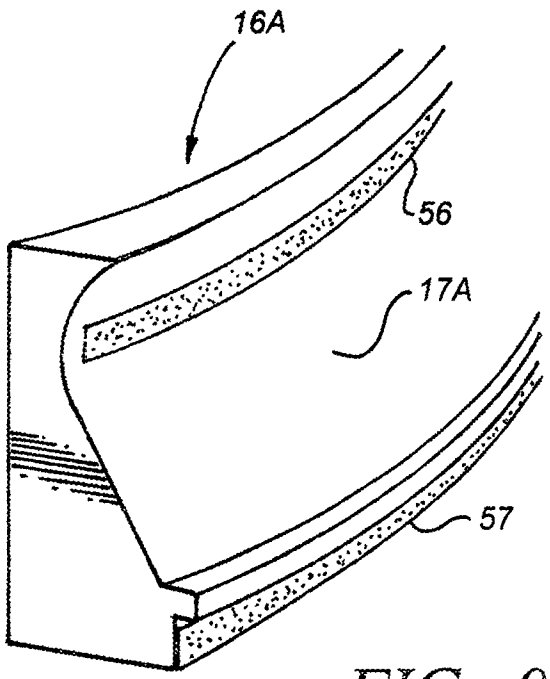
FIG. 9 is a perspective view illustrating the application of tape on the front contoured side of an elongate pliable form in order to strengthen the form and facilitate bending the form for application in a gunite swimming pool.

FIGS. 9 and 10 illustrate the application of tape strips 56, 57, 58, 59 to the inside and back of a form 16A to strengthen form 16A and facilitate bending form 16A to conform to arcuate portions of the top of a swimming pool, pond, etc. The use of such tape strips is well known in the art.

The system of the invention illustrated in FIG. 11 is substantially identical to that illustrated in FIG. 1, except that the form 16C utilized has a bottom surface comprising longitudinal portions, or "flats", 20C and 20D. Form 16C, in a manner similar to that of form 16, includes contoured face 17C and back 18C. Form 16C also includes a lip 19.

FIG. 12 illustrates a form system utilized in a vinyl liner pool. This system, like that illustrated in FIG. 5, utilizes a strip 50 which is secured with fasteners (not shown) along the top of the pool wall. Strip 50 includes, as noted in FIG. 5, a longitudinally extending mouth which receives the edge of a vinyl liner. This mouth includes an upstanding edge 52 and also forms the upper edge 62 of the pool wall. Lip 19E of form 16G conforms to edge 62. Form 16G, like form 16C, has a bottom surface comprises of a pair of longitudinally extending portions, or "flats", 20F and 20G. FIG. 12 illustrates an important feature of head 38; namely, it can, after spear 35 is pushed outwardly through form 16G in a direction toward the interior of a pool, be rotated to the position illustrated in FIG. 12 so that the "beak" or tip 38C of head 38 engages edge 52 to help secure form 16G in place when button 40 is slid over end 37 and against bracket 25. Form 16G, like other forms described herein, includes a contoured face 17G and vertically extending back 18G. The system of FIG. 12 does not, of course, include L-shaped hanger 40A.

The order of installation of the system components in FIG. 12 can vary somewhat; however, the normal sequence is to install strip 50, place form 16 on strip 50, install spear(s) 35, install aperture 28 of each bracket 25 over a different end 37, install button(s) 40, and turn head(s) 38 so tip(s) 38C each engage an edge 52. As would be appreciated by those of skill in the art, in practice a plurality of spaced apart parallel spears 35 or 35A, each having its own associated bracket 25 and button 40, is normally installed along the length of a form 16, 16A, 16C, 16D, 16G.

FIG. 13 illustrates the use of an encapsulation track in conjunction with the invention. Encapsulation tracks are known in the art and are used to provide a way to install a cover over the top of a pool. Elongate, horizontally oriented encapsulation track 70 includes a foot 71 which is secured with fasteners (not shown) to the top 11 of a fiberglass pool (or vinyl-lined pool or gunite pool). The head 38 of a spear 35 is secured with fasteners 60A to a flange 72 or other portion of encapsulation track 70. Edge 61 of track 70 forms the upper edge of the pool deck. Form 16D includes longitudinally extending lip 19D which conforms to edge 61. Form 16D includes contoured face 17D, back 18D, and bottom 20C. The surface 15 of the upper portion of a fiberglass pool typically is canted away from the vertical by an angle indicated by arrows B in FIG. 13. This angle can vary, but in many cases is about seven degrees. In order to compensate for this angle, form 16 can be fabricated such that back 18D is, after form 16G is installed in its desired position and orientation on the edge of a pool, similarly canted away from the vertical by a corresponding angle indicated by arrows C in FIG. 13. Back 18D can also, if desired, be canted away from vertical to compensate for pad 44 pushing foot 32 outwardly away from surface 15. As would be appreciated by those of skill in the art, the shape and dimension of a form 16, 16A, 16C, 16D, 16G or bracket 25 or spear 35 can be varied as desired.

Particular advantages of the form system of the invention with respect to a fiberglass or vinyl lined swimming pool are that bracket 25 and form 16, 16A, 16C, 16D, 16G are shaped and dimensioned such that when the bracket 25 is placed against the form, it conforms to the form such that the bracket 25 is automatically properly positioned to be in registration with a spear 35 or 35A, to have aperture 28 in registration with reference line 21, to receive the end 37 or 37A of the spear, to support the form in the desired position with respect to the bracket, and to generate a compression vector, $V_C$, which frictionally secures the bracket to the wall of the swimming pool. Contacting the bottom 20, 20C, 20D, 20E, 20F, 20G of a form with leg 29 supports the form in a desired position and helps to prevent the form from sagging downwardly under the force of gravity, particularly after concrete has been formed to make a pool deck. The frictional engagement by surface 44A of foot 32 is critical because it prevents having to damage the pool wall or use a cement or adhesive to secure fixedly (and not frictionally) foot 32 to the surface of fiberglass or of a vinyl liner.

Having described my invention in such terms as to enable those of skill in the art to understand and practice it, and having described various embodiments thereof, I claim:

1. A form system for a swimming pool having a substantially vertically extending pool wall circumscribing an interior reservoir space and including a top including an upper edge, and, an inner surface extending downwardly from said upper edge and comprised of a material selected from a group consisting of fiberglass and vinyl, said system comprising (a) an elongate form of a semirigid material (i) having a longitudinal length, (ii) pliable along said longitudinal length, (iii) substantially rigid transverse of said longitudinal length, (iv) having a contoured face to form a deck coping, said contoured face extending at least in part over said interior reservoir space, (v) having a substantially vertical back spaced apart from and opposed to said face, (vi) having a longitudinal lip below said contoured face and conforming to and contacting said upper edge, (vii) having a bottom surface, (viii) having a horizontally oriented reference line extending across said back, and (ix) extending outwardly from said pool wall over the interior reservoir space;

(b) a bracket including (i) a vertically oriented head with an inner surface contacting said back of said form, said inner surface shaped and dimensioned to conform to and support said back of said form, and an aperture extending through said head, (ii) a leg having an upper end connected to said head, extending beneath said form downwardly from said head at an angle A to the pool wall, having a lower end, and contacting and supporting said bottom surface of said form, (iii) a foot connected to and extending outwardly from said lower end of said leg and frictionally non-fixedly contacting said inner surface of said pool wall;

(c) an elongate spear (i) having a head secured in position above the top of the pool wall, (ii) including a leg extending through said elongate form, said leg having a serrated end extending through and outwardly away from said vertical back through said aperture in said head of said bracket;

(d) a locking button fixedly slidably mounted on said serrated end and against said head to compress said form against the pool wall, said angle between said leg and the pool wall being in the range of twenty degrees and sixty degrees such that said foot generates a compression force vector, $V_C$, to (e) press said foot against the pool wall, and (f) increase frictional engagement between said foot and the pool wall sufficiently to maintain said foot in position on the pool wall and support said form when concrete contacts said contoured face extending over said interior reservoir space; said form and said bracket being shaped and dimensioned such that when said serrated end of said spear passes through said aperture in said bracket, said leg of said bracket contacts said bottom of said form and supports said form.

2. A form system for a swimming pool having a substantially vertically extending pool wall circumscribing an interior reservoir space and including a top including an upper edge, and, an inner surface extending downwardly from said upper edge and comprised of a material selected from a group consisting of fiberglass and vinyl, said system comprising (a) an elongate form of a semirigid material (i) having d longitudinal length, (ii) pliable along said longitudinal length, (iii) substantially rigid transverse of said longitudinal length, (iv) having a contoured face to form a deck coping, said contoured face extending at least in part over said interior reservoir space, (v) having d substantially vertical back spaced apart from and opposed to said face, (vi) having a longitudinal lip below said contoured face and conforming to and contacting said upper edge, (vii) having a bottom surface, (viii) having a horizontally oriented reference line extending across said back, and (ix) extending outwardly from said pool wall over the interior reservoir space;

(b) a bracket including (i) a vertically oriented head with an inner surface contacting said back of said form, said inner surface shaped and dimensioned to conform to and support said back of said form, and an aperture extending through said head, (ii) a leg having an upper end connected to said head, extending beneath said form downwardly from said head at an angle A to the pool wall, having a lower end, (iii) a foot connected to and extending outwardly from said lower end of said leg and engaging said inner surface of said pool wall;

(c) an elongate spear (i) having a head secured in position above the top of the pool wall, (ii) including a leg extending through said elongate form, said leg having a serrated end extending through and outwardly away from said vertical back through said aperture in said head of said bracket;

(d) a locking button fixedly slidably mounted on said serrated end and against said head to compress said form against the pool wall, said angle between said leg and the pool wall being in the range of twenty degrees and sixty degrees such that said foot generates a compression force vector, $V_C$, to (e) press said foot against the pool wall, and (f) increase frictional engagement between said foot and the pool wall sufficiently to maintain said foot in position on the pool wall and support said form when concrete contacts said contoured face extending over said interior reservoir space; said form and said bracket being shaped and dimensioned such that when said serrated end of said spear passes through said aperture in said bracket, said leg of said bracket contacts said bottom of said form and supports said form.

* * * * *